US005393258A

United States Patent [19]

Karterman

[11] Patent Number: 5,393,258

[45] Date of Patent: Feb. 28, 1995

[54] AIR ACTUATED AMUSEMENT DRINKING DEVICE FOR MOUNTING ON A BEVERAGE CONTAINER

[76] Inventor: Don S. Karterman, 675 Birch St., Anchorage, Ak. 99501

[21] Appl. No.: 112,951

[22] Filed: Aug. 30, 1993

[51] Int. Cl.[6] ..... A63H 33/00

[52] U.S. Cl. ..... 446/71; 446/77; 446/200; 446/201; 446/236; 446/243

[58] Field of Search ..... 446/71, 75–77, 446/176, 185, 199–202, 236, 243, 205; 239/33; 215/1 A; 220/705, 709, 703, 714; 229/103.1; 222/40

[56] References Cited

U.S. PATENT DOCUMENTS

| | | | |
|---|---|---|---|
| 2,513,066 | 6/1950 | Stahl | 446/200 |
| 2,544,594 | 3/1951 | Goldfarb . | |
| 2,987,848 | 6/1961 | Neuhaus et al. . | |
| 3,296,735 | 1/1967 | Djedda . | |
| 3,315,405 | 4/1967 | Hoffer | 446/71 |
| 3,332,622 | 7/1967 | Lombard | 239/33 |
| 3,512,299 | 5/1970 | Meyer | 446/200 |
| 3,782,028 | 1/1974 | Kelly . | |
| 3,834,068 | 9/1974 | Fabricant | 446/200 |
| 4,579,281 | 4/1986 | Karterman | 446/200 |

FOREIGN PATENT DOCUMENTS

| | | | |
|---|---|---|---|
| 16953 | 8/1882 | Germany | 446/200 |

*Primary Examiner*—Robert A. Hafer
*Assistant Examiner*—Jeffrey D. Carlson
*Attorney, Agent, or Firm*—Warren F. B. Lindsley

[57] ABSTRACT

A cover for fitting over the open end of a can, glass, cup or carton type beverage container which employs a straw extending into the container for siphoning liquid therefrom and an impeller mounted in a trough in the housing forming a part of the cover for connecting to and rotating a display device, the improvement including the utilization of an air stream into the cover and against the impeller created by the negative pressure created in the container upon withdrawal of beverage therefrom for rotating the impeller.

12 Claims, 3 Drawing Sheets

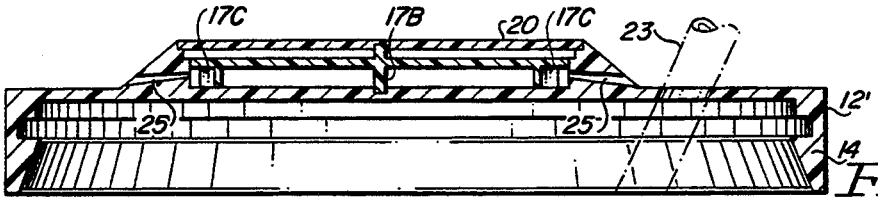
FIG. 2A
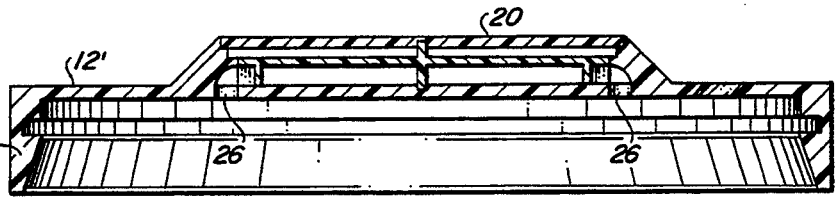
FIG. 3A
FIG. 4
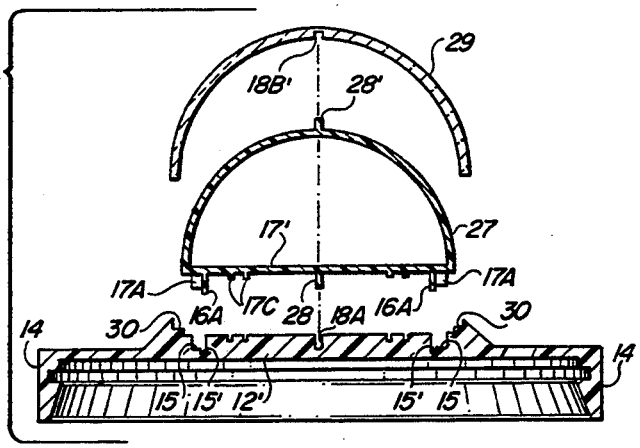
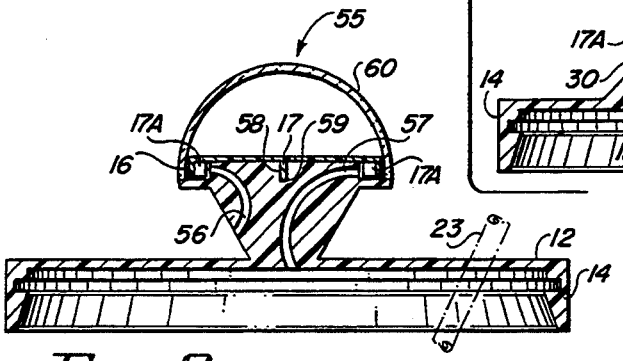
FIG. 9
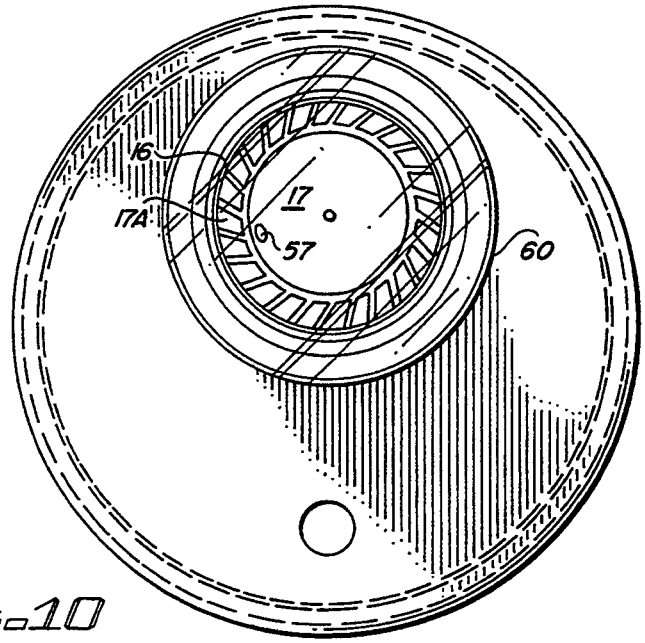
FIG. 10

FIG. 5
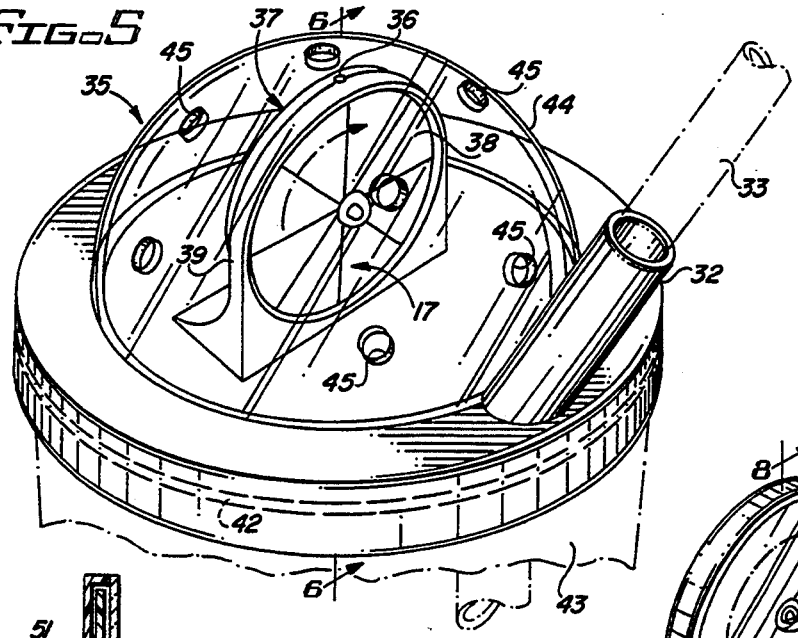
FIG. 7
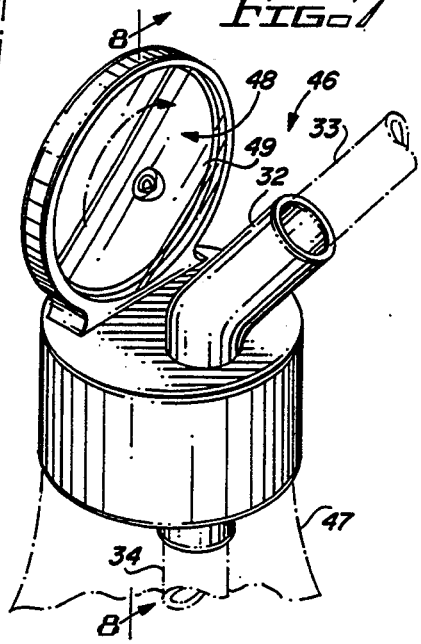
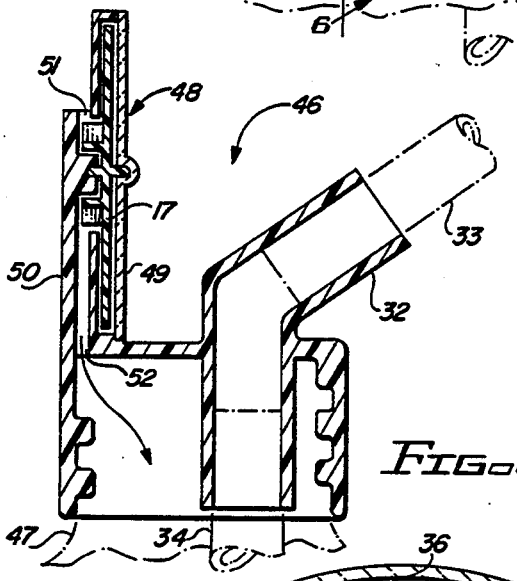
FIG. 8
FIG. 6
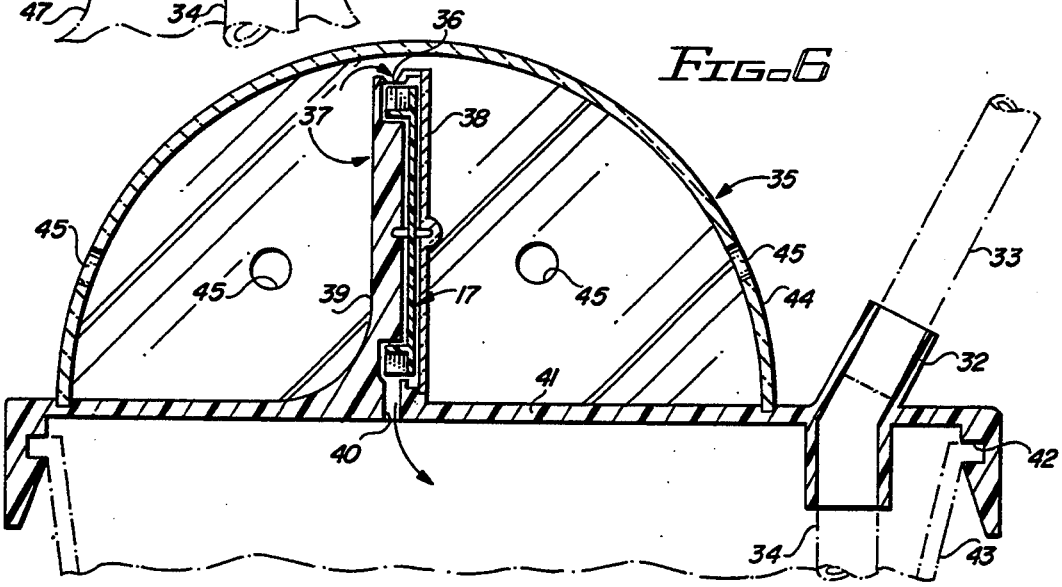

AIR ACTUATED AMUSEMENT DRINKING DEVICE FOR MOUNTING ON A BEVERAGE CONTAINER

BACKGROUND OF THE INVENTION

This invention relates to drinking devices which are mounted on a glass, can, bottle or carton type beverage container for amusement and entertainment purposes while drinking the beverage.

DESCRIPTION OF THE PRIOR ART

Various types of entertainment devices have been provided for mounting on a beverage containing glass, can, bottle or carton but none have been successfully marketed because the amount of effort of the user whether child or adult was discouraging or exhausting. Further, most of the known amusement drinking devices cause the beverage to be detoured or deviated from a direct course of the beverage from the container to the mouth of the user thereby losing some of its freshness when it arrived in the user's mouth.

U.S. Pat. No. 2,544,594 discloses a child's feeding device which is placed on any container or drinking glass which is filled with a liquid such as milk or the like with a tube extending into the liquid. When a child sucks up the liquid in the tube, the suction will cause the liquid to pass into the tube through openings and bores and out at an angle striking vanes or blades of the device causing a platform to rotate like a merry-go-round.

U.S. Pat. No. 2,987,848 discloses a toy aeroplane of the helicopter type wherein the propeller is rotated by an air pump actuated by the squeezing of a rubber ball.

U.S. Pat. No. 3,296,735 discloses a whirling toy driven by suction produced on air current.

The toy has a dome-shaped housing having a single opening in its dome constituting an air inlet opening and a single opening in its base through which air may be withdrawn by suction. The openings are radially spaced and define a path of air flow therebetween as air is withdrawn by suction through the opening in the base. This air flow impinges upon the air-impinging surface means of the figures to cause a rotatable shaft to rotate.

U.S. Pat. No. 3,782,028 discloses a toy operated by a drinking straw comprising a hollow tube through which liquid flows. A screw in the tube is rotated by the liquid flow.

Thus, a need exist for an improved air actuating display which results from the suction of the beverage being withdrawn from its container through a straw of the user.

SUMMARY OF THE INVENTION

In accordance with the invention claimed, a cover for fitting over the open top of a glass, cup, bottle, can or carton type container is provided which employs a straw extending into the container for siphoning liquid therefrom. A suitable opening is provided in the cover for receipt of atmospheric air which is drawn into the display upon suction provided by the user of the straw. The cover is adapted to provide an impeller in the incoming air stream, which upon beverage withdrawal, flows therethrough under the effects of the suction to rotate a display, moving object or provides a given entertainment function.

It is, therefore, one object of this invention to provide a new and improved device for detachably mounting on a glass, can, bottle, carton or other beverage type container which provides amusement for the user while drinking the beverage.

Another object of this invention is to provide a cover for a beverage container which provides an air actuated rotating display as a result of withdrawal of beverage from the container.

A further object of this invention is to provide a plurality of spacedly arranged paddles around the circumference of a disc and in an air confining trough for rotating the disc.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which:

FIG. 2A is a diagrammatic illustration of a modification of FIG. 1;

FIG. 3A is a diagrammatic illustration of a modification of FIG. 1;

FIG. 4 is a cross sectional view of a modification of FIG. 1 illustrating a dome configuration for covering the movable display;

FIG. 5 is a modification of the display devices shown in FIGS. 1-3 with the rotating device being mounted vertically on the container;

FIG. 6 is a cross sectional view of FIG. 5 taken along the line 6—6;

FIG. 7 is a modification of the display device shown in FIGS. 5 and 6 mounted on a bottle; and FIG. 8 is a cross sectional view of FIG. 7 taken along the line 8—8;

FIG. 9 is a modification of FIGS. 1 and 4 showing a plug type display device for insertion into the normal opening of the top of a beverage container;

FIG. 10 is a top view of FIG. 9 showing the inlet and outlet ports;

DESCRIPTION OF THE PREFERRED EMBODIMENT

The unique feature of this rotating amusement device is the utilization of an air actuated rotating display in place of a beverage actuated rotating display. Since the movement of an air jet into the display is a result of the negative pressure in the beverage container created by the user withdrawing the beverage through a straw, the resulting rotational display effect is created without exhausting the user.

Figure 1:
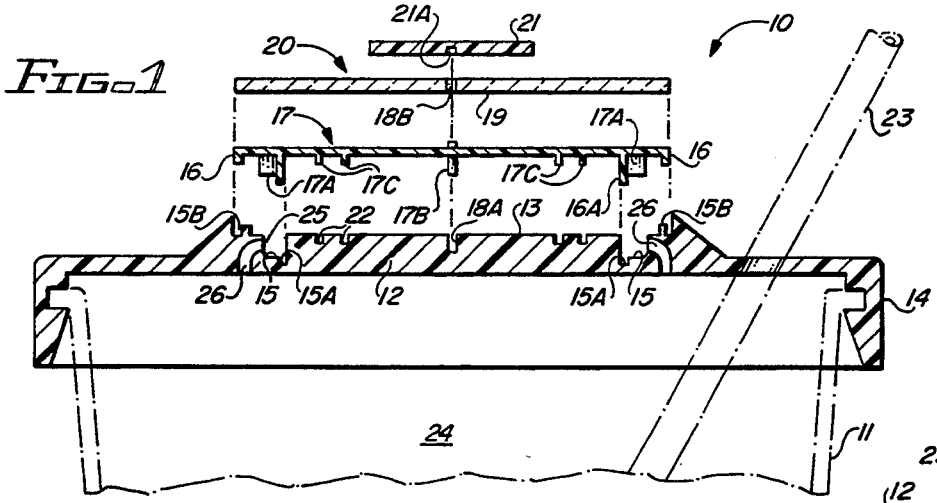
FIG. 1 is a cross sectional view of a display device mounted on a beverage cup or can and embodying the invention.

FIG. 1 discloses an amusement device 10 mounted on and over the open end of a soda can, glass or cup 11 hereinafter referred to as a container which may be formed or cast of glass, plastic or other suitable materials.

Device 10 comprises a cover 12 having a flat top or cover surface 13 with an annular flange 14 for engaging the upper end or lip of the container in an airtight friction bearing manner.

This cover comprises angular troughs 15, 15A and 15B in its upper surface which provide circular tracks or troughs for maintaining therein circular flanges 16 and 16A of a rotating impeller 17. Fins 17A of impeller 17 extend into trough 15.

This impeller comprises a disc shaped member a shaft 17B of which is loosely journalled in a pair of supports, bearings or keepers 18A and 18B mounted axially thereof with keeper 18A formed in the top surface 13 of cover 12 and keeper 18B formed in the bottom surface 19 or through cover or transparent lens 20 of device 10. An outside rotor 21 is mounted over the top end of shaft 17B.

Disc shaped member 17 is provided with a plurality of blades or fins 17A spacedly arranged around the periphery thereof on its bottom surface and arranged to extend laterally thereof in the manner shown in FIG. 1 into trough 15. Thus, fins 17A extend around the periphery of disc-shaped member 17 in the manner of the blades on a turbine wheel and positioned in trough 15 formed in cover 12.

As shown in FIG. 1, air is drawn into cover 12 of amusement device 10 at an angle to the planar surface of fins 17A to eliminate any dead spots in the rotation of impeller 17.

It should be noted the disk member 17 is provided with circular fences, air block or ribs 17C which provide rigidity to the structure with cover 12 being provided with troughs 22 for receiving the fences or ribs 17C when in assembled form.

As noted in FIG. 1, troughs 15, 15A and 15B are conformed along their lower edges to provide air block channels or troughs for keeping the jet stream caused by the vacuum like conditions in device 10 to be maintained until the jet stream passes through outlet ports 26 and enters into container 11.

Figure 2:
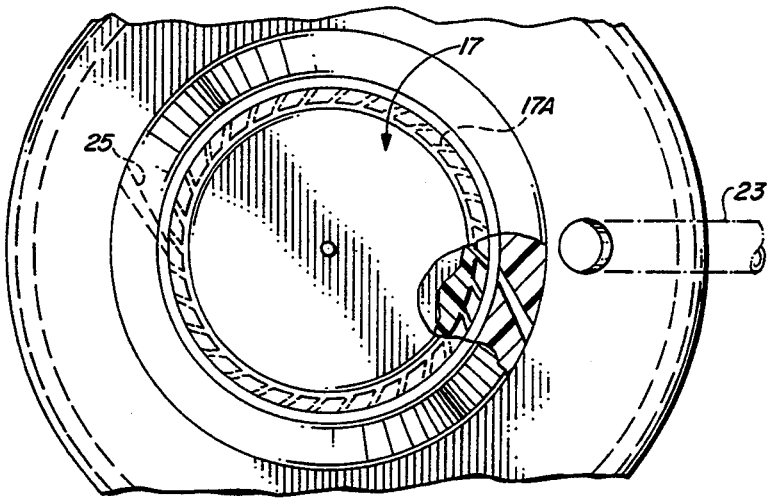
FIG. 2 is a top view of FIG. 1 showing the inlet ports.
Figure 3:
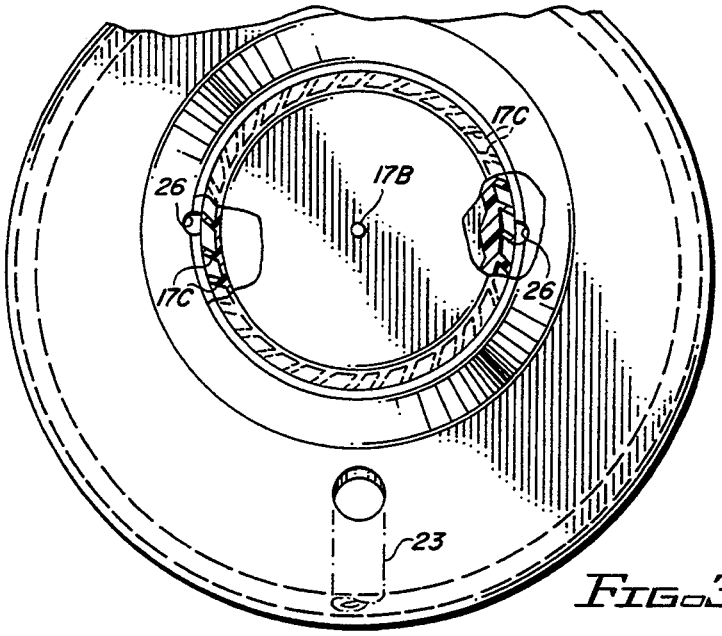
FIG. 3 is a bottom view of the display device rotated 90 degrees from that shown in FIG. 2 and illustrating the outlet ports of the device.

Thus, when a user sucks on a straw 23, which extends through cover 12 in an airtight arrangement, to draw beverage 24 out of container 11, air is drawn into device 10 through one or more inlet ports 25 shown in FIGS. 2 and 2A arranged diametrically of each other on opposite sides of cover 20 and out of one or more outlet ports 26 being diagonally spaced from each other and ninety degrees from said inlet ports as shown in FIG. 3 and 3A into container 11 by means of the negative pressure created by beverage withdrawal from the substantially airtight container 11.

Air jets created by inlet ports 25 under the negative pressure conditions created by removing beverage 24 through straw 23 from cup or container 11 impinge on fins 17A causing impeller 17 to rotate. As shown in FIGS. 1, 2 and 3, the paddles or fins 17A are arranged around the periphery of the impeller in a suitable trough but may be arranged in a circular path at any distance spaced from the axis of the impeller and still fall within the scope of this invention.

Since cover 20 may be transparent, any graphics on its top surface could serve an entertainment function.

FIGS. 2A and 3A illustrate modifications of FIGS. 1, 4, 6, 8, 9 and 10, respectively, wherein troughs 15, 15A and 15B are omitted and flanges 16A and fins 17A extending to the top surfaces of cover 12.

FIG. 4 illustrates a modification of FIGS. 1–3 wherein like parts are given the same or similar reference characters. Cover 12' is similar to cover 12 of FIGS. 1, 2 and 3 except trough 15B shown in FIG. 1 is omitted. Further, impeller 17' of FIG. 4 does not have the circular flange 16 of FIG. 1. Still further, a hollow plastic dome 27 is mounted to enclose the top surface of impeller 17'. This dome increases the printing area of the amusement device without adding to the air reservoir. FIG. 4 illustrates a modification of shaft 17B wherein shafts 28 and 28' preform its function. As shown, shaft 28 fits into a cavity or keeper 18A in cover 12 and shaft 28' fits into a further cavity 18B in a second dome 29. Dome 29 fits over dome 27 and into troughs 30 formed in the top surface of cover 12.

FIGS. 5 and 6 illustrate a dome covered amusement device 35 having impeller 17 axially mounted in a vertical position with a single air inlet port 36 provided at the top of a housing 37 formed by parts 38 and 39. An outlet port 40 is provided in housing 37 at the bottom thereof which extends through a cover 41 of the amusement device. Cover 41 fits tightly over a rim 42 of a container 43 as heretofore explained with straw 33 mounted to extend partially into one end of a holder 32 forming a part of cover 41, as shown in FIGS. 5 and 6, with a second straw 34 extending out of the other end of holder 32.

An apertured dome 44 is mounted over housing 37 and provides through apertures 45 formed therein passages for atmospheric air to flow therethrough and through inlet port 36 to impeller 17.

FIGS. 7 and 8 disclose an amusement device 46 that is designed for fitting over the neck of a bottle 47. Device 46 is threadedly mounted on bottle 47 in an airtight arrangement with the rotatably mounted impeller 17 vertically mounted in a suitable bearing in a housing 48. The housing comprises a pair of parts 49 and 50 which enclose impeller 17 for rotation therein in the manner disclosed in the description of FIG. 1.

Housing 48 provides an inlet port 51 and an outlet port 52 which opens into the neck of bottle 47, as shown in FIG. 8 with straw 33 being mounted in a holder 32 in the manner shown in FIGS. 5 and 6.

Thus, an amusement device is disclosed for mounting on a can, bottle, cup, carton or other suitable container that is air actuated for rotating a suitable display on the impeller.

It should be noted that the fins or blades of the impeller may be designed to form a curved cup or blade that creates a negative force immediately behind the blade to aid in rotation of the impeller.

It should be noted that the various circular flanges and ribs, shown on impeller 17 fit into the associated troughs for controlling and maintaining the vacuum created by the withdrawal of beverage from an associated container.

Since the amount of vacuum created is small, it is necessary to control the flow of atmospheric air into and through the amusement device. Thus, the flanges and ribs of the impeller are form fitted to closely mate with the associated troughs formed in the upper or cover surface 13 of cover 12.

For example, circular flange 16 fits into trough 15B. Circular flange 16A fits into trough 15A and ribs 17C of impeller 17 fit into circular troughs 22.

Thus, air drawn into the amusement device through inlet port 25 upon withdrawal of beverage from cup 11 through straw 23 is directed at fins 17A and is maintained in trough 15 with little loss of directional positive air flow over the cover surface 13 of cover 12 essentially barred by flange 16 and ribs 17C.

Flange 16, shown in FIG. 1, keeps outside air from traveling through shaft openings 18B into trough 15. Any air that is able to get into the housing other than through inlets 25 decreases the efficiency of the device. Thus, flange 16 keeps the air from traveling over the impeller 17. Flange 16A keeps any uncontrolled air from traveling over the top of cover surface 13.

Further, it should be noted from FIGS. 2A that the air jet introduced to the device through inlet ports 25 are angled to hit the paddles or fins 17A of impeller 17 at an upward angle thereby causing the impeller 17 to float as the incoming jet of air hits that part of the impeller extending over paddle or fins 17A. A pair of inlet ports is used to balance the impeller when acted upon by the incoming jets of air.

FIGS. 9 and 10 disclose a further modification of the amusement devices shown in FIGS. 1–8 wherein like parts are given the same reference character. A plug or stopper type device 55 is provided on cover 12 which fits over the open end of cup 11, as shown in FIG. 1. Device 55 comprises a frustum of a cone of revolution having inlet and outlet channels 56, 57 formed in the solid configuration of the cone shaped stopper or plug 55. The inlet port and channel 56 starts along the side of the plug and continues into and through the plug with an exit adjacent the channel or trough 15 within which the fins 17A travel as heretofore described.

The air drawn into the amusement device through straw 23 and channel 56 exits from the amusement device through channel 57 and into the beverage container 11.

As shown in the drawing, impeller 17 is provided with a shaft 58 that is journalled in a slot or keeper 59 formed in the top surface of plug 55. Impeller 17 is provided with the heretofore defined fins 17A mounted around its outer periphery with circular flange 16 forming an air block for confining the air flow to the area of the fins. The impeller is covered with an airtight dome 60 which may be formed of a clear plastic.

Figure 11:
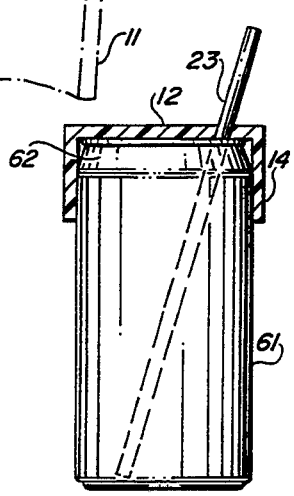
FIG. 11 is a modification of a beverage can configuration for use with an amusement device such as that shown in FIG. 1.

FIG. 11 is a diagrammatic illustration of the utilization of an amusement device such as shown in this application on a container such as a beverage can 61 that is necked down at its top 62 in an airtight arrangement. The only difference over the structure shown in FIGS. 1–10 is that the annular flange 14 of the cover 12 extends along the sides of the beverage can rather than gripping it at its top as shown in FIG. 1.

Figure 12:
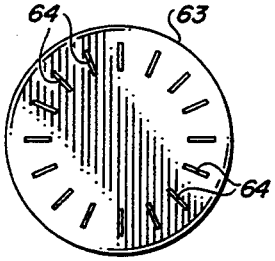
FIG. 12 illustrates a modification of the impeller shown in FIG. 1.

FIG. 12 illustrates a modification of the impeller 17 shown in FIG. 1 wherein impeller 63 comprises a flat disc having grooves 64 formed in its bottom surface against which the incoming stream of air impinges against for rotating the impeller rather than fins 17A as shown in FIG. 1.

Although a few embodiments of the invention have been illustrated and described, it will be apparent to those skilled in the art that various changes and modifications may be made therein without departing from the spirit of the invention or from the scope of the appended claims.

What is claimed is:

1. An amusement drinking device for mounting on a beverage container and operable upon withdrawal of the beverage from the container comprising:

a cover for fitting over the open end of a beverage container in an airtight arrangement, said cover having a port for receiving a straw extending therethrough and into the beverage in an airtight arrangement, an impeller journalled in said cover for rotation thereof and forming with an exposed surface of said cover a housing therebetween, said impeller being actuated by jets of air drawn into said housing upon withdrawal of beverage from the container through the straw, said cover defining a circular trough in said exposed surface thereof, said impeller having at least a series of sequentially arranged parts mounted in a circle for positioning in said trough, said housing defining an inlet port and an outlet port, said inlet port being open to atmospheric pressure and formed to direct a series of jets of incoming air against said parts of said impeller in said trough and an outlet port for discharging said air from said housing into the associated beverage container, whereby suction created in the associated container upon withdrawal of beverage therefrom through the straw creates a negative pressure in said housing which causes said jets of air to be drawn into said trough in said housing, directed against said parts of said impeller causing rotation of said impeller and into the associated container.

2. The amusement drinking device set forth in claim 1 in further combination with:

a display mounted on said impeller for rotation therewith.

3. The amusement drinking device set forth in claim 1 wherein:

said cover is adapted to be threadedly mounted to a container.

4. The amusement drinking device set forth in claim 1 wherein:

said impeller is loosely journalled in said housing for limited axial floating movement thereof upon movement of said jets of air through said housing.

5. The amusement drinking device set forth in claim 1 wherein:

said impeller is disc shaped and said parts of said impeller comprise a plurality of fins spacedly arranged around its outer periphery.

6. The amusement drinking device set forth in claim 1 wherein:

said impeller is disc shaped and said parts of said impeller comprise a plurality of fins spacedly arranged around said impeller at a point spaced from the axis of said impeller.

7. The amusement drinking device set forth in claim 5 wherein:

said inlet port is formed in said housing to direct a series of jets of air passing therethrough at an angle to said fins.

8. The amusement drinking device set forth in claim 5 wherein:

said housing is provided with a second inlet port and a second outlet port, each of said inlet ports being diagonally spaced around said disc, and each of said outlet ports being diagonally spaced from each other and around said disc ninety degrees from said inlet ports.

9. The amusement drinking device set forth in claim 8 in further combination with:

at least one circular rib is mounted on the bottom of said impeller for closely fitting into a second circular trough formed in the top surface of said cover for limiting air flow in said housing over said impeller.

10. The amusement drinking device set forth in claim 5 wherein:

said jets of incoming air are directed outwardly of said impeller against said fins.

11. The amusement drinking device set forth in claim 5 wherein:

said jets of incoming air are directed inwardly of said impeller against said fins.

12. The amusement drinking device set forth in claim 5 in further combination with:

a groove formed in said cover and surrounding said trough, said impeller defining a circular flange for fitting into said groove in said cover for blocking atmospheric air flow into said housing, said impeller comprises an axle extending laterally therefrom for journalling in said first housing with one end extending outwardly thereof, and a rotor mounted on the end of said axle extending outwardly of said impeller.

* * * * *